US006351966B1

(12) United States Patent
Hochberg

(10) Patent No.: US 6,351,966 B1
(45) Date of Patent: Mar. 5, 2002

(54) DEVICE FOR SUPPLYING WATER TO A REFRIGERATOR ICEMAKER

(76) Inventor: Peter H. Hochberg, 1050 21st Avenue NW. A23, Hickory, NC (US) 28601

( * ) Notice: Subject to any disclaimer, the term of this patent is extended or adjusted under 35 U.S.C. 154(b) by 0 days.

(21) Appl. No.: 09/697,981

(22) Filed: Oct. 26, 2000

(51) Int. Cl.[7] ..... F25C 23/12
(52) U.S. Cl. ..... 62/340; 62/66
(58) Field of Search ..... 62/340, 347, 397, 62/389, 66

(56) References Cited

U.S. PATENT DOCUMENTS

| | | | | |
|---|---|---|---|---|
| 1,142,210 A | * | 6/1915 | Wagner | 62/340 |
| 4,027,499 A | | 6/1977 | Barto et al. | |
| 4,456,149 A | | 6/1984 | Sciortino | |
| 4,815,941 A | * | 3/1989 | Fayo | 62/340 |
| 4,987,746 A | | 1/1991 | Roberts | |
| 5,297,401 A | | 3/1994 | Hawco | |
| 5,405,526 A | * | 4/1995 | Sutera | 210/124 |
| 5,495,725 A | * | 3/1996 | Middlemiss | 62/340 |
| 5,558,256 A | | 9/1996 | Miller et al. | |
| D405,004 S | | 2/1999 | Mudra et al. | |

* cited by examiner

*Primary Examiner*—William E. Tapolcal
*Assistant Examiner*—Mohammad M. Ali

(57) ABSTRACT

A device for supplying water to a refrigerator icemaker for supplying bottled water to the icemaker in a refrigerator. The device for supplying water to a refrigerator icemaker includes a container having water therein. The container has a bottom wall, a top wall and a peripheral wall coupled thereto and extending between the top and bottom walls. The housing has a lumen therein. The top wall has an opening therein for access to the lumen. A peripheral lip is coupled to and extends away from an edge of the opening. A cover member for selectively coupling to the peripheral lip and cover member the opening has a first hole and a second hole extending therethrough. A first tubular member for supplying water to the refrigerator is elongate and has a first end fluidly coupled to the first hole and a second end fluidly coupled to an inlet of the refrigerator. A second tubular member for supplying air to the container is elongate and has a first end and a second end. The second tubular member extends through the second hole and into the container. A stand holds the container in a generally upside down orientation.

7 Claims, 2 Drawing Sheets

DEVICE FOR SUPPLYING WATER TO A REFRIGERATOR ICEMAKER

BACKGROUND OF THE INVENTION

1. Field of the Invention

The present invention relates to water supplying devices for refrigerators and more particularly pertains to a new device for supplying water to a refrigerator icemaker for supplying bottled water to the icemaker in a refrigerator.

2. Description of the Prior Art

The use of water supplying devices for refrigerators is known in the prior art. More specifically, water supplying devices for refrigerators heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,987,746; 5,297,401; 5,558,256; 4,456,149; U.S. Pat. Des. No. 405,004; and U.S. Pat. No. 4,027,499.

While these devices fulfill their respective, particular objectives and requirements, the aforementioned patents do not disclose a new device for supplying water to a refrigerator icemaker. The inventive device includes a container having water therein. The container has a bottom wall, a top wall and a peripheral wall coupled thereto and extending between the top and bottom walls. The housing has a lumen therein. The top wall has an opening therein for access to the lumen. A peripheral lip is coupled to and extends away from an edge of the opening. A cover member for selectively coupling to the peripheral lip and cover member the opening has a first hole and a second hole extending therethrough. A first tubular member for supplying water to the refrigerator is elongate and has a first end fluidly coupled to the first hole and a second end fluidly coupled to an inlet of the refrigerator. A second tubular member for supplying air to the container is elongate and has a first end and a second end. The second tubular member extends through the second hole and into the container. A stand holds the container in a generally upside down orientation.

In these respects, the device for supplying water to a refrigerator icemaker according to the present invention substantially departs from the conventional concepts and designs of the prior art, and in so doing provides an apparatus primarily developed for the purpose of supplying bottled water to the icemaker in a refrigerator.

SUMMARY OF THE INVENTION

In view of the foregoing disadvantages inherent in the known types of water supplying devices for refrigerators now present in the prior art, the present invention provides a new device for supplying water to a refrigerator icemaker construction wherein the same can be utilized for supplying bottled water to the icemaker in a refrigerator.

The general purpose of the present invention, which will be described subsequently in greater detail, is to provide a new device for supplying water to a refrigerator icemaker apparatus and method which has many of the advantages of the water supplying devices for refrigerators mentioned heretofore and many novel features that result in a new device for supplying water to a refrigerator icemaker which is not anticipated, rendered obvious, suggested, or even implied by any of the prior art water supplying devices for refrigerators, either alone or in any combination thereof.

To attain this, the present invention generally comprises a container having water therein. The container has a bottom wall, a top wall and a peripheral wall coupled thereto and extending between the top and bottom walls. The housing has a lumen therein. The top wall has an opening therein for access to the lumen. A peripheral lip is coupled to and extends away from an edge of the opening. A cover member for selectively coupling to the peripheral lip and cover member the opening has a first hole and a second hole extending therethrough. A first tubular member for supplying water to the refrigerator is elongate and has a first end fluidly coupled to the first hole and a second end fluidly coupled to an inlet of the refrigerator. A second tubular member for supplying air to the container is elongate and has a first end and a second end. The second tubular member extends through the second hole and into the container. A stand holds the container in a generally upside down orientation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new device for supplying water to a refrigerator icemaker apparatus and method which has many of the advantages of the water supplying devices for refrigerators mentioned heretofore and many novel features that result in a new device for supplying water to a refrigerator icemaker which is not anticipated, rendered obvious, suggested, or even implied by any of the prior art water supplying devices for refrigerators, either alone or in any combination thereof.

It is another object of the present invention to provide a new device for supplying water to a refrigerator icemaker which may be easily and efficiently manufactured and marketed.

It is a further object of the present invention to provide a new device for supplying water to a refrigerator icemaker which is of a durable and reliable construction.

An even further object of the present invention is to provide a new device for supplying water to a refrigerator icemaker which is susceptible of a low cost of manufacture with regard to both materials and labor, and which accordingly is then susceptible of low prices of sale to the consuming public, thereby making such device for supplying water to a refrigerator icemaker economically available to the buying public.

Still yet another object of the present invention is to provide a new device for supplying water to a refrigerator icemaker which provides in the apparatuses and methods of the prior art some of the advantages thereof, while simultaneously overcoming some of the disadvantages normally associated therewith.

Still another object of the present invention is to provide a new device for supplying water to a refrigerator icemaker for supplying bottled water to the icemaker in a refrigerator.

Yet another object of the present invention is to provide a new device for supplying water to a refrigerator icemaker which includes a container having water therein. The container has a bottom wall, a top wall and a peripheral wall coupled thereto and extending between the top and bottom walls. The housing has a lumen therein. The top wall has an opening therein for access to the lumen. A peripheral lip is coupled to and extends away from an edge of the opening. A cover member for selectively coupling to the peripheral lip and cover member the opening has a first hole and a second hole extending therethrough. A first tubular member for supplying water to the refrigerator is elongate and has a first end fluidly coupled to the first hole and a second end fluidly coupled to an inlet of the refrigerator. A second tubular member for supplying air to the container is elongate and has a first end and a second end. The second tubular member extends through the second hole and into the container. A stand holds the container in a generally upside down orientation.

Still yet another object of the present invention is to provide a new device for supplying water to a refrigerator icemaker that allows a user to use bottled water for ice cubes to greater enhance the flavor of the ice cubes.

Even still another object of the present invention is to provide a new device for supplying water to a refrigerator icemaker that is retrofittable to existing refrigerators having icemakers therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
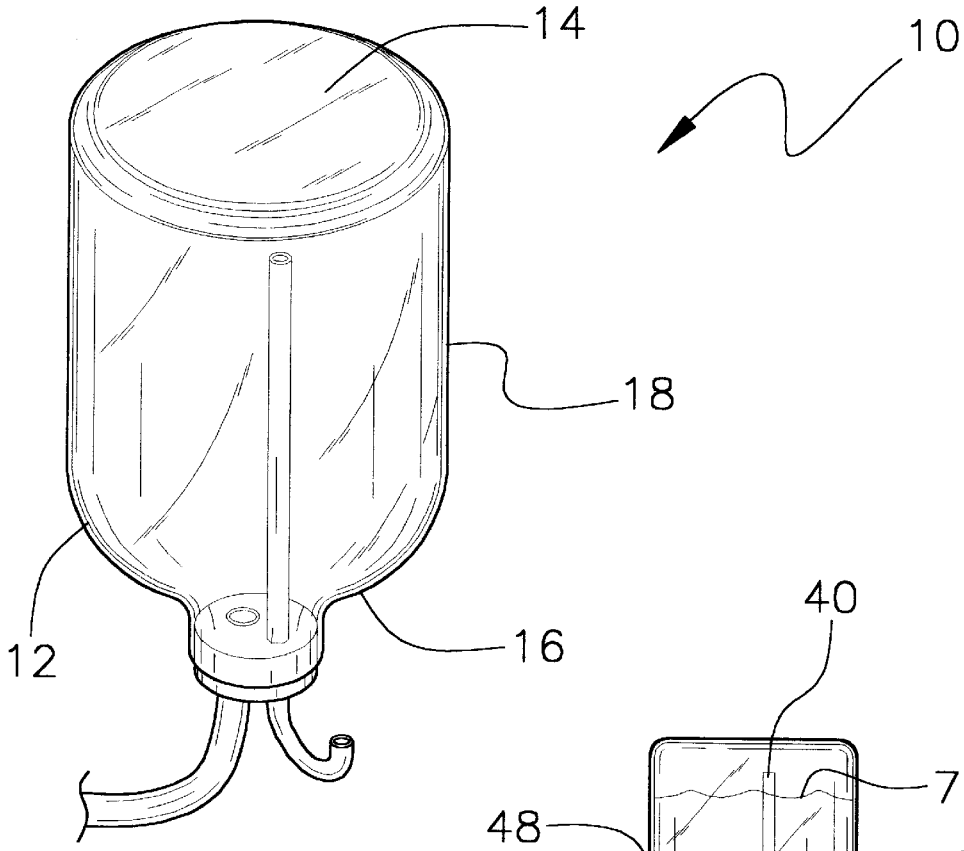
FIG. 1 is a schematic perspective view of a new device for supplying water to a refrigerator icemaker according to the present invention.
Figure 2:
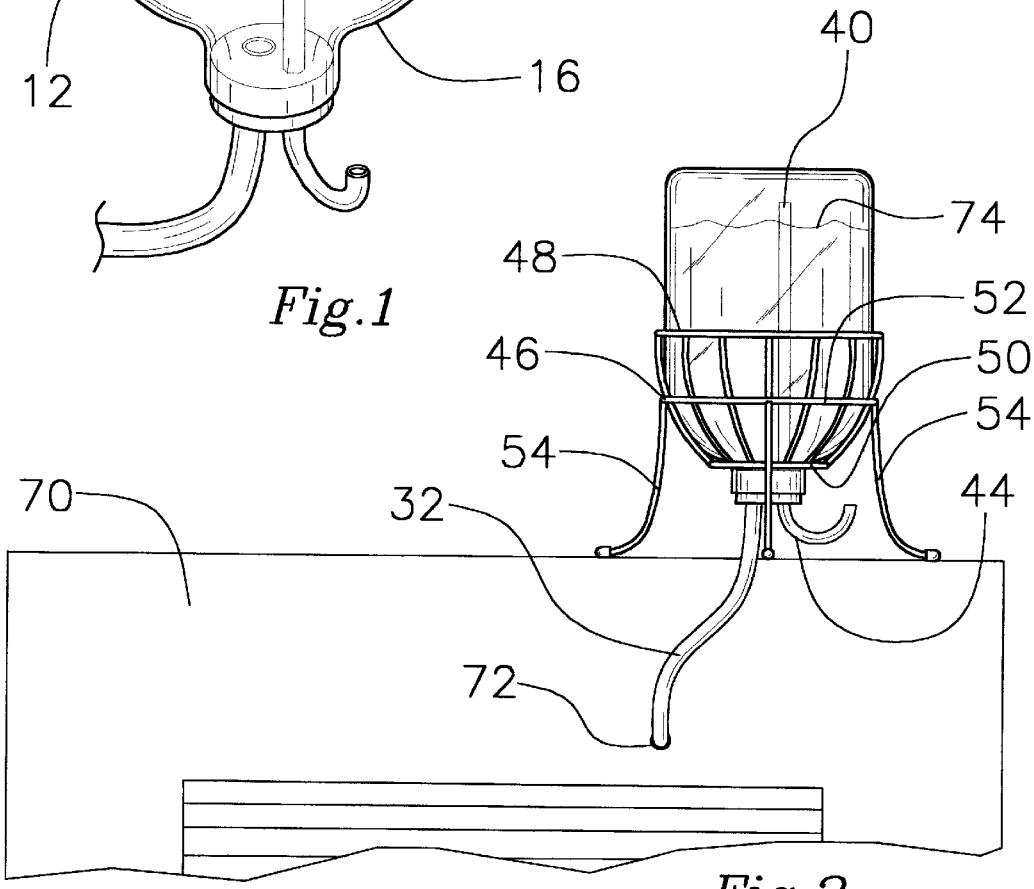
FIG. 2 is a schematic side view of the present invention.
Figure 3:
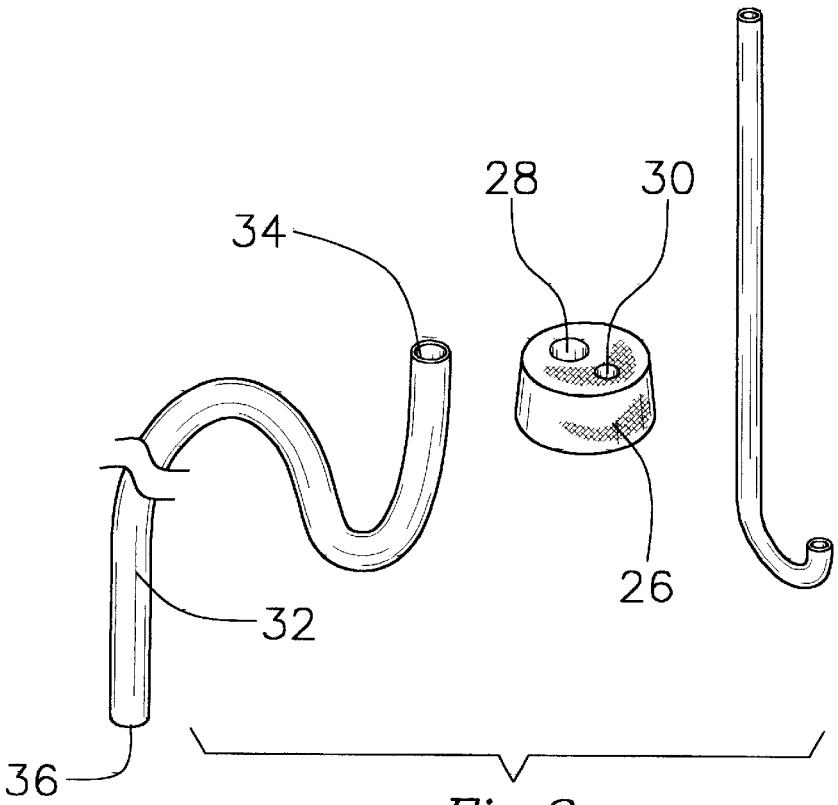
FIG. 3 is a schematic perspective view of the stopper and tubular member of the present invention.
Figure 4:
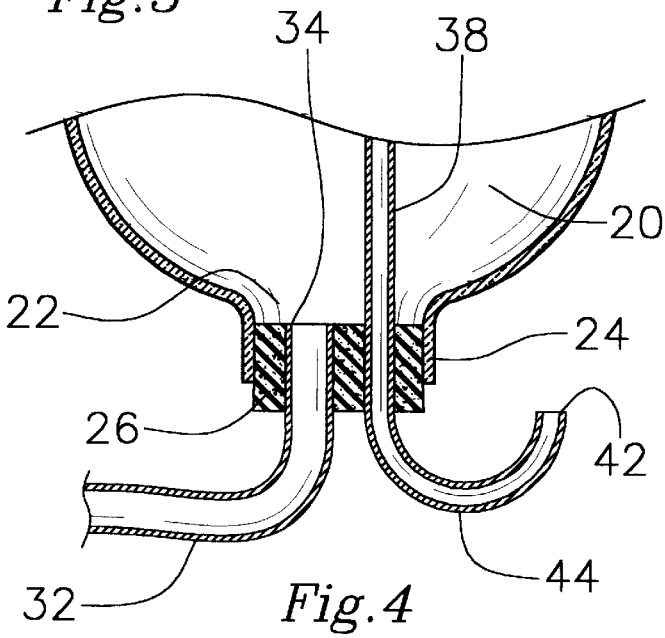
FIG. 4 is a schematic cross-sectional view of the present invention.

With reference now to the drawings, and in particular to FIGS. 1 through 4 thereof, a new device for supplying water to a refrigerator icemaker embodying the principles and concepts of the present invention and generally designated by the reference numeral 10 will be described.

As best illustrated in FIGS. 1 through 4, the device for supplying water to a refrigerator icemaker 10 generally comprises a container 12. The container 12 has a bottom wall 14, a top wall 16 and a peripheral wall 18 is coupled to and extends therebetween. The housing 12 has a lumen 20 therein. The top wall 16 has an opening 22 therein for access to the lumen 20. A peripheral lip 24 is coupled to and extends away from an edge of the opening 22. The container 12 has water 74 therein.

A cover member 26 selectively covers the opening 22. The cover member 26 has a first hole 28 and a second hole 30 therethrough. The cover member 26 comprises a stopper. The stopper has a size and shape for positioning in the opening such that the stopper is abutted against an inside surface of the peripheral lip 24. The stopper comprises a resiliently flexible material. The resiliently flexible material comprises an elastomeric material.

A first tubular member 32 supplies water to a refrigerator 70. The first tubular member 32 is elongate and has a first end 34 fluidly coupled to the first hole 28 and a second end 36 fluidly coupled to an inlet 72 in the refrigerator 70. The first tubular member 32 is resiliently flexible.

A second tubular member 38 supplies air to the container 12. The second tubular member 38 is elongate and has a first end 40 and a second end 42. The second tubular member 38 extends through the second hole 30 and into the container 12 and has a length such that the first end 40 of the second tubular member may be positioned generally adjacent to the bottom wall 14 when the second end 42 of the second tubular member 38 is outside of the container 12. The second tubular member 38 is substantially rigid. The second tubular member 38 has a bend 44 therein, which is nearer the second end 42 of the second tubular member 38. The second tubular member 38 generally has a J-shape.

A stand 46 for holding the container 12 in a generally upside down orientation comprises a bowl having a top edge 48, a bottom edge 50 and a perimeter wall 52 extending therebetween. The bowl has an open top side and an open bottom side. The container 12 is positionable upside down in the bowl such that the peripheral lip 24 extends through the open bottom side. A plurality of legs 54 is coupled to and extending downwardly from the perimeter wall 52 such that the bottom side of the bowl is spaced from the refrigerator 70.

In use, the container 12, which is preferably a conventional water bottle, is placed upside down in the stand 46. The stopper is positioned in the bottle with the second tubular member 38 extending to a point above the water 74 line. The water 74 leaves the container through the first tubular member 32 and enters the refrigerator 70 to be made into ice cubes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for supplying water to a refrigerator ice maker, the refrigerator having an inlet for transporting water to the ice maker, said device comprising:

a container, said container having a bottom wall, a top wall and a peripheral wall being coupled to and extending therebetween, said container having a lumen therein, said top wall having an opening therein for access to said lumen, a peripheral lip being coupled to and extending away from an edge of said opening, said container having water therein;

a cover member for selectively coupling to said peripheral lip and cover member said opening, said cover member having a first hole and a second hole therethrough;

a first tubular member for supplying water to the refrigerator, said first tubular member being elongate and having a first end fluidly coupled to said first hole and a second end fluidly coupled to said inlet;

a second tubular member for supplying air to said container, said second tubular member being elongate and having a first end and a second end, said second tubular member extending through said second hole and into said container, said second tubular member extending through said second hole and into said container such that said first end of said second tubular member may be positioned generally adjacent to said bottom wall when said second end of said second tubular member is outside of said container; and a stand for holding said container in a generally upside down orientation.

2. The device for supplying water as in claim 1, additionally comprising a stopper having a size and shape for positioning in said opening such that said stopper is abutted against an inside surface of said peripheral lip.

3. The device for supplying water as in claim 2, wherein said stopper comprises a resiliently flexible material, said resiliently flexible material comprising an elastomeric material.

4. The device for supplying water as in claim 1, wherein said second tubular member is substantially rigid, said second tubular member having a bend therein, said bend being nearer said second end of said second tubular member, said second tubular member generally having a J-shape.

5. The device for supplying water as in claim 1, wherein said stand further comprises:

a bowl having a top edge, a bottom edge and a perimeter wall extending therebetween, said bowl having an open top side and an open bottom side, said container being positionable upside down in said bowl such that said peripheral lip extends through said open bottom side, a plurality of legs being coupled to and extending downwardly from said perimeter wall such that said bottom side of said bowl is spaced from said refrigerator.

6. A device for supplying water to a refrigerator ice maker, the refrigerator having an inlet for transporting water to the ice maker, said device comprising:

a container, said container having a bottom wall, a top wall and a peripheral wall being coupled to and extending therebetween, said container having a lumen therein, said top wall having an opening therein for access to said lumen, a peripheral lip being coupled to and extending away from an edge of said opening, said container having water therein;

a cover member for selectively cover member said opening, said cover member having a first hole and a second hole therethrough, said cover member comprising a stopper, said stopper having a size and shape for positioning in said opening such that said stopper is abutted against an inside surface of said peripheral lip, said stopper comprising a resiliently flexible material, said resiliently flexible material comprising an elastomeric material;

a first tubular member for supplying water to the refrigerator, said first tubular member being elongate and having a first end fluidly coupled to said first hole and a second end fluidly coupled to said inlet, said first tubular member being resiliently flexible;

a second tubular member for supplying air to said container, said second tubular member being elongate and having a first end and a second end, said second tubular member extending through said second hole and into said container such that said first end of said second tubular member may be positioned generally adjacent to said bottom wall when said second end of said second tubular member is outside of said container, said second tubular member being substantially rigid, said second tubular member having a bend therein, said bend being nearer said second end of said second tubular member, said second tubular member generally having a J-shape; and a stand for holding said container in a generally upside down orientation, said stand comprising a bowl having a top edge, a bottom edge and a perimeter wall extending therebetween, said bowl having an open top side and an open bottom side, said container being positionable upside down in said bowl such that said peripheral lip extends through said open bottom side, a plurality of legs being coupled to and extending downwardly from said perimeter wall such that said bottom side of said bowl is spaced from said refrigerator.

7. A device for supplying water to a refrigerator ice maker, the refrigerator having an inlet for transporting water to the ice maker, said device comprising:

a container, said container having a bottom wall, a top wall and a peripheral wall being coupled to and extending therebetween, said container having a lumen therein, said top wall having an opening therein for access to said lumen, a peripheral lip being coupled to and extending away from an edge of said opening, said container having water therein;

a cover member for selectively coupling to said peripheral lip and cover member said opening, said cover member having a first hole and a second hole therethrough;

a first tubular member for supplying water to the refrigerator, said first tubular member being elongate and having a first end fluidly coupled to said first hole and a second end fluidly coupled to said inlet;

a second tubular member for supplying air to said container, said second tubular member being elongate and having a first end and a second end, said second tubular member extending through said second hole and into said container, said second tubular member being substantially substantially rigid, said second tubular member having a bend therein, said bend being nearer said second end of said second tubular member, said second tubular member generally having a J-shape;

a stand for holding said container in a generally upside down orientation.

* * * * *